US005807438A

United States Patent [19]

Lansbergen et al.

[11] Patent Number: 5,807,438

[45] **Date of Patent: *Sep. 15, 1998**

[54] DETERGENT COMPOSITION AND METHOD FOR WAREWASHING

[75] Inventors: Adrianus Joseph Lansbergen, Maarssen; Robert Jan Uhlhorn, Woerden, both of Netherlands

[73] Assignee: Diversey Lever, Inc., Plymouth, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 560,225

[22] Filed: Nov. 22, 1995

[30] Foreign Application Priority Data

Nov. 24, 1994 [GB] United Kingdom ..... 9423952

[51] Int. Cl.[6] ..... C11D 3/386; C11D 3/395; B08B 3/02

[52] U.S. Cl. ..... 134/25.2; 134/25.5; 134/29; 510/220; 510/224; 510/226; 510/367; 510/374

[58] Field of Search ..... 510/220, 224, 510/226, 367, 374; 134/25.2, 25.5, 29

[56] References Cited

U.S. PATENT DOCUMENTS

| | | | |
|---|---|---|---|
| 3,332,882 | 7/1967 | Blumberg et al. | 252/186.4 |
| 4,128,494 | 12/1978 | Schirmann et al. | 8/111 |
| 4,620,936 | 11/1986 | Kielman et al. | 510/226 |
| 4,729,845 | 3/1988 | Altenschoepler | 252/99 |
| 4,751,015 | 6/1988 | Humphreys et al. | 510/376 |
| 4,818,426 | 4/1989 | Humphreys et al. | 510/375 |
| 5,064,561 | 11/1991 | Rouillard | 510/234 |
| 5,240,633 | 8/1993 | Ahmed et al. | 510/221 |
| 5,356,483 | 10/1994 | Saalmann et al. | 134/25.2 |
| 5,374,369 | 12/1994 | Angevaare et al. | 510/220 |
| 5,453,216 | 9/1995 | Kellett | 225/174.13 |
| 5,468,410 | 11/1995 | Angevaare et al. | 510/220 |
| 5,480,576 | 1/1996 | Gary et al. | 510/220 |
| 5,480,577 | 1/1996 | Nicholson et al. | 510/372 |
| 5,559,089 | 9/1996 | Hartman et al. | 510/224 |
| 5,578,136 | 11/1996 | Taylor et al. | 139/25.2 |
| 5,741,767 | 4/1998 | Nicholson et al. | 521/220 |

FOREIGN PATENT DOCUMENTS

| | | |
|---|---|---|
| 256 343 | 2/1988 | European Pat. Off. . |
| 282 214 | 9/1988 | European Pat. Off. . |
| 318 204 | 8/1989 | European Pat. Off. . |
| 4 219 620 | 12/1993 | Germany . |
| 838 988 | 6/1960 | United Kingdom . |
| 1 243 784 | 8/1971 | United Kingdom . |
| 1 296 839 | 11/1972 | United Kingdom . |
| 94/27488 | of 0000 | WIPO . |
| 91/10719 | 7/1991 | WIPO . |
| 94/17170 | 4/1994 | WIPO . |

OTHER PUBLICATIONS

International Search Report.
European Search Report.
P. Bernfeld, *"Method of Enzymology"*, vol. 1 (1955), p. 149.
M.L. Anson, The Influence of Tension and Relaxation of Altechutures *"Journal of General Physilogy"*, vol. 22 (1938), p. 79.

*Primary Examiner*—Kery Fries
*Attorney, Agent, or Firm*—A. Kate Huffman

[57] ABSTRACT

A chemical cleaning system and a method of using the same in multiple zone mechanical warewashing is described. The cleaning system contains at least two separate components for aqueous dissolution or dilution to respective use concentrations, the system comprising a cleaning agent, a bleach and enzyme. Each component is dissolved or diluted to the use concentration and introduced sequentially into the warewashing apparatus.

6 Claims, No Drawings

DETERGENT COMPOSITION AND METHOD FOR WAREWASHING

FIELD OF THE INVENTION

The present invention relates to cleaning compositions and their use in mechanical warewashing, especially in institutional or industrial systems having multiple zones or tanks.

BACKGROUND OF THE INVENTION

A conventional industrial warewashing system consists of a conveyor system separated into prewash, wash, rinse and drying zones. Wash water is introduced into the rinse zone of the system and is passed cascade fashion towards the prewash zone while dishware is transported in a counter-current direction. The dishwashing compositions used in the system generally contain a cleaning ingredient such as an aqueous solution of a caustic agent (e.g. sodium hydroxide), a sequestering agent such as sodium tripolyphosphate, and a chlorine bleaching agent. Contact time of the cleaning composition with the dishware is typically quite short, e.g. about 1 minute. The cleaned dishware is generally rinsed in the final rinse station, using a dilute solution of a rinse aid containing a nonionic surfactant.

In a variation of the conventional system described above, a cleaning component is separately introduced into the prewash or wash zone while the bleaching agent is subsequently introduced into a second wash zone, followed by the rinse zone. In these conventional systems the separate cleaning and bleaching solutions are generally applied in the dishwasher using suitable upwardly and downwardly directed spray nozzles or jets. As the dishware passes through each zone, most of the solution is recycled, while the remainder drains away.

One problem which arises in industrial warewashing is the buildup of starchy stains. Starchy stains are especially difficult to remove when dishware is subjected to high temperatures during food preparation and such foods are left for a long time on heated substrates during distribution. A proposed solution to this problem is disclosed by EP-A-282, 214. This document relates to a process for cleaning dirty dishware with a non-directional mist-like spray of a strongly alkaline solution. However, a highly alkaline spray is potentially hazardous for the operator.

An industrial dishwashing process using a low alkaline detergent and an enzyme dosed into either a rinsing or washing bath of the dishwasher is described in WO 94/27488 (Henkel-Ecolab). The publication describes a means of compensating for degradation of the enzyme, particularly an amylase, during stand still phases by adding intermittent doses of the enzyme to the washing zone.

German Patent Specification DE-A-4 219 620 describes a domestic dishwasher in which bleach- and enzyme-containing components are dosed in different stages of the wash process. The enzyme is added during the pre-rinse or at the very beginning of the wash cycle. The bleach is added only during the cleaning cycle after a predetermined time once the wash liquor reaches a desired temperature. There are no examples of suitable compositions described in the specification.

Thus, there still exists a need for an improved cleaning composition and method of mechanical warewashing which overcome the disadvantages of the prior art.

SUMMARY OF THE INVENTION

A first aspect of the invention provides a chemical cleaning system for a multi-tank mechanical warewashing machine having at least two separate components for aqueous dissolution or dilution to respective use concentrations, a first component comprising a bleach or a mixture of a bleach and a cleaning agent, and a second component comprising an enzyme wherein the first component is introduced into a first wash zone then the second component is introduced into a second wash zone to substantially clean washware.

A highly effective method of warewashing in a multi-tank industrial or institutional machine is also described, said method comprising the steps of:

1) formulating at least two separate components of a chemical cleaning system for aqueous dissolution or dilution to respective use concentrations, a first component comprising a bleach or a mixture of a bleach and a cleaning agent, and a second component comprising an enzyme;
2) introducing the first component into a first washing zone to clean dirty dishware;
3) subsequently introducing the second component comprising the enzyme into a second washing zone of the system to complete the cleaning of the dirty dishware; and
4) finally rinsing the dishware to substantially rinse away the chemical cleaning system.

DETAILED DESCRIPTION OF PREFERRED EMBODIMENTS

The system of the present invention can be regarded as falling into two main categories, which for convenience here are referred to as "high pH" and "low pH" systems. The high pH systems are those for which , when that component which contains the cleaning agent is diluted to the use concentration, results in an aqueous solution having a pH greater than 10 (hereinafter called the "high pH system"). The low pH systems are those for which, when that component which contains the cleaning agent is diluted to the use concentration, results in an aqueous solution having a pH from 7 to 10 (hereinafter called the "low pH system").

It is possible that both high and low pH systems according to the present invention contain a cleaning agent in more than one component thereof. In that case, the phrase "that component which contains the cleaning agent" refers to the component which contains the greatest total amount (% by weight) of cleaning agent. Of course, it is possible, within the scope of the present invention, for high and low pH systems to comprise three or more components, two of which contain substantially the same total amount (% by weight) of cleaning agent, in which case the category of high or low pH systems will be determined by the total cleaning agent concentration of both. It will also be appreciated that the total cleaning agent in any given component may comprise two or more different individual cleaning agents, as will be explained in more detail below.

In both low pH and high pH systems according to the present invention, the system pH will be chosen on a variety of criteria, such as the other ingredients in the same component or the particular intended application. Thus, preferred ranges of system pH for the high pH compositions may have a minimum chosen from any of pH 10.1–14.0 (provided of course, that the maximum is greater than the minimum).

Similarly, preferred ranges of system pH for the low pH compositions may have a minimum chosen from any of pH 7.0 to 9.0. Independently of the minimum, the maximum of such preferred ranges of system pH for these low pH systems may be chosen from any of 8.0 to 10.0 (again provided that the maximum is greater than the minimum).

The system pH, i.e. the pH of the aqueous solution resulting from dissolution or dilution to the use concentration of that component which contains the (most) cleaning agent is of course different from the pH of the component per se, before dilution (hereinafter called the "original pH").

For high pH systems, the original pH will typically be in the range of from 10 to 14, preferably from 11 to 14, more preferably from 12 to 14.

For low pH systems, the original pH will typically be in the range of from 7 to 13, preferably from 7 to 11, more preferably from 8 to 11.

Typical aqueous dissolution or dilution rates (dosing rates) for the component containing the (most) cleaning agent are such that the weight of component per unit volume of water are in the range of from 1 to 5 g/l, preferably from 1 to 4 g/l, more preferably from 1 to 3 g/l.

The cleaning agent content of that component (or those components) may include one or more agents selected from caustic (strongly alkaline) materials, builders (i.e. detergency builders including the class of chelating agents/sequestering agents) and surfactants.

Suitable caustic agents include alkali metal hydroxides, e.g. sodium or potassium hydroxides, and alkali metal metasilicates, e.g. sodium metasilicate. Especially effective is sodium silicate having a mole ratio of $SiO_2$:$Na_2O$ of from about 1.0 to about 3.3, preferably from about 1.8 to about 2.2, normally referred to as sodium disilicate.

Suitable builder materials (phosphates and non-phosphate builder materials) are well known in the art and many types of organic and inorganic compounds have been described in the literature. They are normally used in all sorts of cleaning compositions to provide alkalinity and buffering capacity, prevent flocculation, maintain ionic strength, extract metals from soils and/or remove alkaline earth metal ions from washing solutions.

The builder material usable herein can be any one or mixtures of the various phosphate and non-phosphate builder materials. However, non-phosphate builder materials can also be used, such as, for example, the alkali metal citrates, carbonates and bicarbonates; and the salts of nitrilotriacetic acid (NTA); dipicolinic acid (DPA), oxydisuccinic acid (ODS), alkyl and alkenyl succinates (AKS); ethylenediamine tetracetates, oxidized heteropolymeric polysaccharides, polycarboxylates such as polymaleates, polyacetates, polyhydroxyacrylates, polyacrylate/polymaleate and polyacrylate/polymethacrylate copolymers and the terpolymer of polyacrylate/polymaleate and vinyl acetate (ex. Huls), as well as zeolites; layered silicas and mixtures thereof. They may be present in more than one component of the system but in the only component which contains builder, or in that component which contains the most total builder material (in % by wt.), in the range of from 1 to 50, and preferably from 5 to 40, more preferably from 10 to 30.

Particularly preferred builders are citrates, DPA, ODS, alkenyl succinates, carbonates, bicarbonates, the higher molecular weight block copolymers ITA/VA having MW greater than 60,000, maleic anhydride/(meth) acrylic acid copolymers, e.g. Sokalan CP5 ex BASF; NTA and terpolymers, polyacrylate/polymaleate and vinyl acetate (supplied by Huls).

Scale formation on dishes and machine parts are an important problem that needs to be resolved or at least mitigated in formulating a machine warewashing product, especially in the case of low-phosphate (e.g. less than the equivalent of 20% by weight, particularly 10% by weight of sodium triphosphate) and phosphate-free machine warewashing compositions, particularly zero-P machine warewashing.

In order to reduce this problem, co-builders, such as polyacrylic acids or polyacrylates (PAA), and the various organic polyphosphonates, e.g. of the Dequest range, may be incorporated in one or more system components. For improved biodegradability , co-builders, such as the block co-polymers of formula (I) as defined in published PCT patent specification WO 94/17170 may also be used. In any component the amount of co-builder may be in the range of from 0.5 to 10, preferably from 0.5 to 5, and more preferably from 1 to 5% by weight.

Further, the cleaning agent may comprise one or more surfactants. Surfactant may also be present in one or more of components of the system. However, in the component(s) which contain the most surfactant, they may be present in a range of from 0.5 to 20, preferably from 1 to 15, and more preferably from 3 to 15% by weight. Such surfactant (if present) is of course separate from any surfactant used as rinse aid in the rinse phase, after use of a system according to the present invention.

Normally, in a properly built or highly built composition as is conventional, only small amounts of low- to non-foaming nonionic surfactant, to aid detergency and particularly to suppress excessive foaming caused by some protein soil. Higher amounts of highly detersive surfactants, such as the high HLB nonionic surfactants, the anionic sulphate or sulphonate surfactants and the alkyl polyglycoside class of surfactants, may be used in low builder-containing active/enzyme-based compositions.

These compositions may further include a defoamer. Suitable defoamers include mono- and distearyl acid phosphate, silicone oil and mineral oil. The compositions may include 0.02 to 2% by weight of defoamer, or preferably 0.05 to 1.0%.

BLEACHING AGENT

Turning now to the bleach, this may also be present in more than one component of the system according to the present invention. In the component which contains the halogen bleach the total amount of bleach (as active halogen) may be present in the range of from 1 to 10% , preferably from 2 to 8% and more preferably from 3 to 6% The bleaches may for example be halogen-based bleaches or oxygen-based bleaches. Of course, more than one kind of bleach may be used.

As halogen bleach alkali metal hypochlorite may be used. Other halogen bleaches are alkali metal salts of di- and tri-chloro and di- and tri-bromo cyanuric acids.

Suitable oxygen-based bleaches are the peroxygen bleaches, such as sodium perborate (tetra- or monohydrate), sodium percarbonate or hydrogen peroxide. These are preferably used in conjunction with a bleach activator which allows the liberation of active oxygen species at a lower temperature. Numerous examples of activators of this type, often also referred to as bleach or peracid precursors, are known in the art and amply described in the literature such as in U.S. Pat. No. 3,332,882 and 4,128,494 herein incorporated by reference. Preferred bleach activators are tetraacetyl ethylene diamine (TAED), sodium nonanoyloxybenzene sulphonate (SNOBS), glucose pentaacetate (GPA), tetra acetylmethylene diamine(TAMD), triacetyl cyanurate, sodium sulphonyl ethyl carbonic acid ester, sodium acetyloxybenzene and the mono long-chain acyl tetraacetyl glucoses as disclosed in WO 91/10719, but other activators, such as choline sulphophenyl carbonate (CSPC), as disclosed in U.S. Pat. Nos. 4,751,015 and 4,818,426 can be used.

Peroxybenzoic acid precursors are known in the art as described in GB 836,988, herein incorporated by reference. Examples of suitable precursors are phenylbenzoate, phenyl p-nitrobenzoate, o-nitrophenyl benzoate, o-carboxyphenyl benzoate, p-bromophenyl benzoate, sodium or potassium benzoyloxy benzene-sulfonate and benzoic anhydride.

Preferred peroxygen bleach precursors are sodium p-benzoyloxy-benzene sulfonate, N,N,N,N-tetraacetyl ethylene diamine (TAED), sodium nonanoyloxybenzene sulfonate (SNOBS) and choline sulfophenyl carbonate (CSPC).

The amounts of sodium perborate or percarbonate and bleach activator in the compositions preferably do not exceed 30% and 10% by weight, respectively, e.g. from 4–30% and from 2–10% by weight, respectively.

Enzymatic Component

Amylolytic and/or proteolytic enzymes would normally be used. The amylolytic enzymes usable herein can be those derived from bacteria or fungi. Preferred amylolytic enzymes are those prepared and described in GB Patent No. 1,296,839, cultivated from the strains of *Bacillus licheniformis* NCIB 8061, NCIB 8059, ATCC 6334, ATCC 6598, ATCC 11945, ATCC 8480 and ATCC 9945 A. Examples of such amylolytic enzymes are those produced and distributed under the tradenames of SP-95 and Termamyl by Novo Industri A/S, Copenhagen, Denmark. These amylolytic enzymes are generally presented as granules or liquids and may have enzyme activities of from about 2 to 25 Maltose Units/milligram. They may be present in the composition of the invention in amounts such that the final composition has amylolytic enzyme activity of from $10^3$ to $10^8$ Maltose Units/kilogram, preferably from $10^5$ to $10^8$ MU/kg and more preferably from $10^6$ to $10^8$ MU/kg.

The amylolytic activity as referred to herein can be determined by the method as described by P. Bernfeld in "Method of Enzymology", Volume I (1955), page 149.

The proteolytic enzymes usable herein are, for example, the subtilisins which are obtained from particular strains of *B. subtilis* and *B. licheniformis*, such as the commercially available subtilisins Maxatase, supplied by Gist-Brocades N.V., Delft, Holland, and Alcalase, supplied by NOVO Industri A/S, Copenhagen, Denmark. Particularly suitable are proteases obtained from s strain of Bacillus having maximum activity throughout the pH range of 8–12, being commercially available from NOVO Industri A/S under the tradenames of Esperase an Savinase. The preparation of these and analogue enzymes is described in GB Patent No. 1,243,784. These enzymes are generally presented as granules, e.g. maruymes, prills, T-granulates, etc., or liquids and may have enzyme activities of from 500 to 6,000 Glycine Units/mg. The proteolytic enzyme activity can be determined by the method as described by M.L. Anson in "Journal of General Physiology", Vol. 22 (1938), page 79 (one Anson unit/gram=733 Glycine Units/milligram).

In the compositions of the invention, proteolytic enzymes may be present in amounts such that the final composition has proteolytic enzyme activity of from about $10^3$ to $10^{10}$ Glycine Units/kilogram, preferably from $10^5$ to $10^{10}$ and more preferably $10^6$ to $10^9$.

Other enzymes, such as lipolytic enzymes, may also be incorporated to improve fat removal. Typical examples of commercial lipolytic enzymes are Lipase YL, Amano CE, Wallerstein AW, Lipase My, and Lipolase ex. Novo Industries.

As indicated above, although the cleaning agent, bleach and enzyme may be present in more than one component of the system, generally speaking, components which contain one of these three classes of ingredients will be substantially free or totally free of the others, apart from the exceptions defined in the following description of preferred orders of application of the components.

Typical industrial warewashing processes are either continuous or non-continuous and are conducted in either a single tank or a multitank/conveyor type machine. In the conveyor system prewash, wash, rinse and drying zones are generally established using partitions. Wash water is introduced into the rinsing zone and is passed cascade fashion back towards the prewash zone while the dirty dishware is transported in a countercurrent direction.

The inventive chemical cleaning system may be utilized in any of the conventional warewashing processes, but is especially effective in multi-tank/conveyor type machines. In these types of machines, contact time between the cleaning composition and the articles to be washed is relatively short. Means of maximizing these contact times are constantly sought while at the same time any negative interaction time of the actives of the cleaning composition needs to be minimized to provide the best cleaning performance.

In sequential dosing, components of the cleaning composition are separately introduced into different compartments of the machine. Thus, sequential dosing separates active ingredients to minimize negative interactions and thereby maximize cleaning performance of each individual component. In a preferred embodiment of the low pH systems, the cleaning agent, bleach and enzyme are each, respectively, three different components to be sequentially introduced into separate washing zones in the order cleaning agent, then bleach, then enzyme; or, most preferably, bleach, then cleaning agent, then enzyme (where "bleach", "enzyme" and "cleaning agent" refer to the component containing a majority of that particular ingredient).

In a preferred low pH system, the bleach, preferably a halogen, is first introduced into a wash or prewash tank, the cleaning agent is then introduced into a second wash tank and the enzyme is introduced into a third washing zone, as described in Examples 3 and 4 below. In the preferred embodiment a bleach scavenger is introduced with the enzyme so that traces of bleach do not deactivate the introduced enzyme.

Alternatively, for low pH systems, the bleach may be applied, followed by a component containing the cleaning agent and the enzyme. Alternatively, a component containing cleaning agent and bleach may be applied before the enzyme.

In a preferred embodiment of the high pH systems, three separate components may be sequentially applied in the order bleach, then cleaning agent then enzyme. In the case of halogen beach, an interim rinse stage could be effectively applied between application of the bleach and cleaning agent, in both low and high pH systems.

For high pH systems containing a non-halogen bleach, the components may be applied in the order cleaning agent, then bleach, then enzyme or a component containing cleaning agent and bleach, then enzyme.

Each of the three components are applied in the machine using conventional means such as suitable spray nozzles or jets directed upwards or downwards toward the dishware. In a preferred embodiment the enzyme component is sprayed directly onto the dishware as it moves through. A thorough rinsing of the enzyme from the dishware should follow.

It will be appreciated that in the above described dosing regimes, there is a general aim of separating bleach and enzyme, because of their inherent incompatibility.

Instead of combining any two of cleaning agent, bleach and enzyme in a single component in the particular two combinations prescribed above, the same may be achieved by mixing separate components respectively containing each at the point of application, either before or after dissolution/dilution.

In all these processes, it will be normal to follow application of all system components by a final rinse using water, preferably containing a rinse aid.

Minor amounts of various other components may be presented in the chemical cleaning system. These components include bleach scavengers, solvents, and hydrotropes such as ethanol, isopropanol and xylene sulfonates, flow control agents; enzyme stabilizing agents; soil suspending agents; antiredeposition agents; anti-tarnish agents; anticorrosion agents; colorants and other functional additives. Particularly useful silver anti-tarnishing agents include benzotriazole or 1,3-N azole compounds described in copending applications having U.S. Ser. Nos. 08/302,284 (Angevaare et al.) and 08/301,459 (Gary et al.) herein incorporated by reference. Isocyanuric acid may also be used as an antitarnishing agent and described in U.S. Pat. No. 5,374,369 (Angevaare et al.) also incorporated by reference.

Components of the present invention may independently be formulated in the form of solids (optionally to be dissolved before use), aqueous liquids or non-aqueous liquid (optionally to be diluted before use).

The present invention will now be described in more detail by way of the following non-limiting examples, in which parts and percentages are by weight unless otherwise indicated.

PREPARATION EXAMPLE 1

A "high pH" system containing following cleaning agent component, bleach component and enzyme component has been formulated.

a. Cleaning Agent Component

| | |
|---|---|
| Potassium hydroxide (50%) | 75% |
| NTA trisodium (40%)[1] | 19% |
| Sodium gluconate | 2% |
| Water | 4% |
| NTA[1]: dosing range is | 1.0–3.0 g/l |

[1]Sodium salt of nitrilotriacetic acid supplied as Trilon A by BASF.

b. Bleach Component

| | |
|---|---|
| Variant (i) Chlorine-based: | |
| Potassium hydroxide (50%) | 6.0% |
| Potassium triphosphate (50%) | 3.0% |
| Neutral sodium silicate 34.4% | 12.0% |
| Sodium hypochlorite (14% act. CL) | 42.8% |
| Water | 36.2% |
| dosing range of this variant (i) | 0.3 to 1.5 g/1 |
| Variant (ii): | |
| Hydrogen peroxide (35%) | 100% |
| dosing range of variant (ii) | 0.2 to 1.0 g/l |

C. Enzyme Component

Termamyl 300 L, being an amylase supplied by NOVO (having an activity of 22 Mu/mg) dosing range: 0.05–0.3 g/l

PREPARATION EXAMPLE 2

A "low pH" system containing following cleaning agent component, bleach component and enzyme component has been formulated.

a. Cleaning Agent Component

| | |
|---|---|
| NTA trisodium (40%)[1] | 70% |
| Potassium hydroxide (50%) | 5.6% |
| Potassium silicate (35%) | 12.5% |
| Dequest-2000 (50%) | 2.0% |
| Water | to 100% |
| dosing range | 1–3 g/l |

b. Bleach Component

| | |
|---|---|
| Hydrogen peroxide (35%) | 10% |
| dosing range | 0.4–1.0 g/l |

c. Enzyme Component

| | |
|---|---|
| Cocktail of amylase and protease: | |
| Termamyl 300 L (amylase) | 10% |
| Savinase 16 L (protease) | 20% |
| Polypropylene glycol | 15% |
| Water | 55% |

EXAMPLE 1, COMPARATIVE EXAMPLES A,B

The cleaning efficiency of a system according to the invention was compared to the cleaning efficiency of two systems of the prior art, in one of which a commercial mechanical warewashing product is used.

The inventive cleaning system having three (3) components was prepared as follows:

A. Bleach component: variant (ii) of preparation example 1

B. Cleaning agent component of preparation example 1

C. Enzymatic component of preparation example 1

The commercial product system of the prior art contained only two (2) components (no enzymes were present) as follows:

A. Cleaning Component

| Ingredients | % Active |
|---|---|
| caustic (NaOH) | 35 |
| antiscalant (phosphonate) | 3 |
| polycarboxylate polymer | 3.6 |
| water | to 100 |

B. Bleach Component of variant (i) example 1

The pH of a lo aqueous solution of the cleaning component was 11.5.

The cleaning performance of both the inventive and the two prior art systems was determined using residual tea stain and residual starch tests.

Porcelain cups are stained with tea three times prior to one washing. Porcelain plates were soiled with potato starch. To mimic the gradual buildup of starch soil due to incomplete removal of the starch in one wash, the starch plates were resoiled after the first wash and in total subjected to 10 consecutive wash/starch soiling procedures.

Cleaning tests were carried out in a multi tank machine with three washing zones. The cleaned dishware was then observed by a panel which rated tea and starch removal on a percentage scale with 100% representing total stain or soil removal.

Methods of introducing the components into the warewasher were as follows:

Inventive cleaning system (Example 1)

cleaning agent component (2.5 g/l), dosed in 2nd washing zone bleach component (0.9 g/l), dosed in 2nd washing zone enzyme component (0.16 g/l), dosed in 3rd washing zone 1st comparative Cleaning system (Comparative Example A)

In this Example, the same components were applied as in the Example 1. However, these components were introduced into the warewasher in a different way, viz.:

cleaning agent component (2.5 g/l), dosed in 3rd washing zone bleaching component (0.9 g/l), dosed in 3rd washing zone enzyme component (0.16 g/l), dosed in 3rd washing zone 2nd comparative Cleaning system (Comparative Example B)

In this system, the above-shown commercial product system was introduced into the warewasher, as follows:

cleaning component (2.5 g/l), dosed in 3rd washing zone bleach component (0.9 g/l), dosed in 3rd washing zone The panel results are as follows:

| | Example no | | |
|---|---|---|---|
| Soil-type: | 1 | A | B |
| tea | 100 | 100 | 95 |
| starch | 70 | 50 | 30 |

It was thus observed that the inventive system of Example 1 exhibited significantly better starch removal performance which also means better overall cleaning efficiency than the cleaning systems of the comparative Examples. It can further be noticed that the effect of sequential dosing of the enzyme component with respect to the bleach and cleaning agent component, is significant.

EXAMPLES 2 AND 3, COMPARATIVE EXAMPLE C

The cleaning efficiency of a "low pH" system according to the invention was compared to the cleaning of a system of the prior art, in which a commercial mechanical warewashing product is used.

The inventive system having three components was prepared as follows:

A. Bleach component: variant (i) of preparation example 1

B. Cleaning agent component of preparation example 2

C. Enzyme component of preparation example 1

The commercial product system is the same as used in Example 1.

The pH of a 1% aqueous solution of the cleaning component was 9.5.

The cleaning performance of the inventive and the prior art system was determined using the same method as applied in Example 1.

Methods of introducing the components into the warewasher were as follows:

Inventive System

Example 2:

bleach component (0.5 g/l), dosed in 1st washing zone cleaning agent component (2.0 g/l), dosed in 3rd washing zone enzyme component (0.08 g/l), dosed in 3rd washing zone Example 3:

bleach component (0.5 g/l), dosed in 1st washing zone cleaning agent component (2.0 g/l), dosed in 2nd washing zone enzyme component (0.08 g/l), dosed in 3rd washing zone Comparative Cleaning System (Comparative Example C)

In this system, the commercial product system was introduced into the warewasher, as follows:

cleaning component (2.5 g/l), dosed in 3rd washing zone bleach component (0.5 g/l), dosed in 3rd washing zone The panel results are as follows:

| | Example no. | | |
|---|---|---|---|
| Soil-type: | 2 | 3 | C |
| tea | 100 | 100 | 100 |
| starch | 70 | 85 | 30 |

It was thus observed that the inventive composition exhibited significantly better starch removal performance which also means better overall cleaning efficiency than the commercial product. This is further improved when the enzyme component is dosed sequentially with respect to both the bleach and the cleaning agent component.

We claim:

1. A method of warewashing in a multi-tank industrial or institutional machine comprising the steps of:

1) formulating three components of a chemical cleaning system for aqueous dissolution or dilution to respective use concentrations, the first component comprising a bleaching agent, the second component comprising an enzyme and a third component comprising a cleaning agent;

2) introducing the first component containing the bleaching agent into a first washing zone to clean dirty dishware;

3) subsequently introducing the third component containing the cleaning agent into a second washing zone to complete the cleaning of the dishware;

4) introducing the second component containing the enzyme into a rinsing zone or a third washing zone; and 5) finally rinsing the cleaned dishware to substantially rinse away the chemical cleaning system.

2. The method according to claim 1, wherein the aqueous solution resulting from the dissolution or dilution of component containing the cleaning agent has a pH of from 7 to 10.

3. The method according to claim 1, wherein an aqueous solution resulting from dissolution or dilution to the use concentration of the component containing the cleaning agent has a pH greater than 10.

4. The method according to claim 1, wherein the enzyme is directly sprayed onto the dirty dishware to complete the cleaning.

5. The method according to claim 1, wherein the second component containing the enzyme further comprises a bleach scavenger agent.

6. The method according to claim 1, wherein the enzyme is selected from the group consisting of an amylase, a protease, a lipase and mixtures thereof.

* * * * *